United States Patent [19]

Loreth et al.

[11] Patent Number: 5,053,912

[45] Date of Patent: Oct. 1, 1991

[54] AIR TRANSPORTING ARRANGEMENT

[75] Inventors: Andrzej Loreth, Akersberga; Vilmos Török, Lidingö, both of Sweden

[73] Assignee: Astra-Vent AB, Stockholm, Sweden

[21] Appl. No.: 573,315

[22] PCT Filed: Feb. 17, 1989

[86] PCT No.: PCT/SE89/00070

§ 371 Date: Sep. 27, 1990

§ 102(e) Date: Sep. 27, 1990

[87] PCT Pub. No.: WO89/08938

PCT Pub. Date: Sep. 21, 1989

[30] Foreign Application Priority Data

Mar. 10, 1988 [SE] Sweden ..... 8800858

[51] Int. Cl.[5] ..... B03C 3/00; H01T 19/04

[52] U.S. Cl. ..... 361/230; 55/150; 55/152

[58] Field of Search ..... 361/230, 231, 232, 215, 361/212; 55/150, 151, 152, 138, 117, 120

[56] References Cited

U.S. PATENT DOCUMENTS

| | | | |
|---|---|---|---|
| 3,184,901 | 12/1959 | Main | 55/138 |
| 4,164,901 | 8/1979 | Everett | 55/138 |
| 4,955,991 | 9/1990 | Torok et al. | 55/120 |
| 4,976,752 | 12/1990 | Torok et al. | 55/117 |

*Primary Examiner*—A. D. Pellinen
*Assistant Examiner*—Christopher S. Schultz
*Attorney, Agent, or Firm*—Browdy and Neimark

[57] ABSTRACT

An arrangement for transporting air with the aid of corona-wind including tubes to extract detrimental side effects from corona discharge. A first tube is arranged with an open end located downstream of and axially in line with the corona electrode, as to face towards the electrode and such that the air flowing past in the vicinity of the corona electrode will flow into the open end of the first tube. A second tube having an open end is positioned upstream of and axially in line with the corona electrode, this second tube being directed downstream. The first tube and the second tube are connected together so that the air flowing in through the open end of the first tube will be conducted to the second tube and flow out through the open end of the second tube in the immediate vicinity of the corona electrode.

10 Claims, 1 Drawing Sheet

AIR TRANSPORTING ARRANGEMENT

Figure 1:
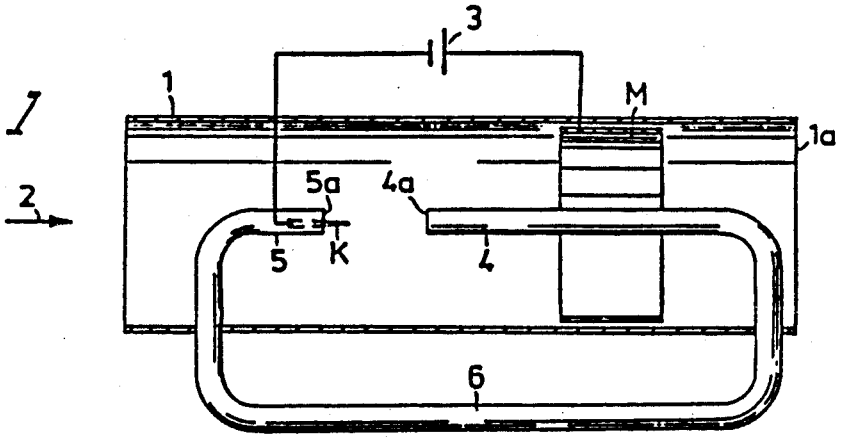

The present invention relates to an arrangement for transporting air with the aid of so-called electric ion-wind or corona-wind.

It is previously known that air can be transported with the aid of a so-called electric ion-wind or corona-wind. In principle, such an arrangement will comprise an airflow duct which includes at least one corona electrode and at least one target electrode which are spaced axially apart in the airflow duct, with the corona electrode located upstream of the target electrode and in which each of the electrodes are connected to a respective terminal of a d.c. voltage source, wherewith the configuration of the corona electrode and the potential difference and distance between the corona electrode and the target electrode are such as to create at the corona electrode a corona discharge which generates air ions. The air ions migrate rapidly to the target electrode, under the influence of the electric field present between corona electrode and target electrode, and deposit their electric charge at the target electrode. During their travel to the target electrode, the ions collide with electrically neutral air molecules, therewith also transferring electrical forces to these latter molecules, such as to entrain said air molecules in a direction towards the target electrode, whereby air is transported in the form of a so-called ion or corona wind. Various embodiments of such air transporting arrangements are described in the literature, for instance in the international patent application PCT/SE85/00538. Such air transporting arrangements can be used solely to transport air, i.e. instead of using a fan or like device for this purpose, or can also be used in systems intended for further treatment of the transported air, such as air cleaning systems, air cooling systems, air heating systems or like air processing systems.

One particular problem encountered with the use of such corona discharge generating arrangements in spaces or locations in which people are to be found, for example, in living accommodations or working accommodations, and also in ventilation systems or air treatment systems which communicate with such spaces or locations, is that the corona discharge will generate chemical compounds, primarily ozone and oxides of nitrogen which are liable to produce an irritating effect and which may even be harmful to people when the concentration of such compounds in air is excessively high. The generation of such irritants in conjunction with a corona discharge takes place at a rate which is contingent on the magnitude of the electrical corona current, and the generation of irritants is much greater in the case of a negative corona discharge than in the case of a positive corona discharge. Consequently, a positive corona discharge has almost always been used in corona discharge arrangements that are located in human environments. The problem of irritant generation also exists, however, when a positive corona discharge is used, and consequently the corona current must be restricted in relation to the quantity of air which passes through the corona discharge arrangement per unit of time, so as to limit the concentration of irritants in said air quantity to acceptable values. The corona current needs to be particularly limited when the arrangement is such that the same air repeatedly passes through the corona arrangement, so that irritants are continuously accumulated in the air. In the case of air transporting arrangements which work with ion-winds, such radical limitation of the corona current renders it difficult in practice to transport sufficiently large quantities of air. The necessity of operating with positive corona discharges has excluded the use of pointed or needle-like corona electrodes, which would otherwise be advantageous both from an electro-technical aspect and a mechanical aspect. When using pointed corona electrodes, or needle-like corona electrodes, and a positive corona discharge, so-called streamers, i.e. elongated, thread-like corona discharge channels, occur readily in the surrounding air and cause the corona discharge to be unstable, therewith resulting in a higher production of irritants.

The Swedish Patent Application 8601817-3 proposes a solution to the aforementioned problem, according to which the air present in the immediate vicinity of the corona electrode is removed continuously and processed in a manner such as to render harmless those substances which are harmful and irritating to humans and generated by the corona discharge. This can be achieved by removing the air present in the immediate vicinity of the corona electrode and releasing said air to the free atmosphere outside the building concerned, where the irritants contained by the air are unable to give rise to any discomfort, or by passing said air through a filter which contains irritant sorbents, so as to remove the irritants from the air. Although this solution of the problem concerned is both effective and totally realistic, it is emcumbered with certain disadvantages. For example, in many instances it is impractical to conduct air which is continuously withdrawn by suction from the immediately vicinity of the corona electrode to a location, for instances to the atmosphere externally of the building concerned, where it can be released to no disadvantage. Neither is the necessity of arranging a separate filter for cleasing air which is continuously removed from the immediate vicinity of the corona electrode always suitable in practice. Furthermore, the earlier proposed solution may require the provision of a separate suction fan for withdrawing and carrying away the air present in the immediately vicinity of the corona electrode. Admittedly, it is mentioned in the Swedish Patent Application 8601817-3, in connection with the description of an embodiment illustrated in FIG. 3 of the drawings of this application, that the airflow prevailing in the airflow duct and generated by an external fan or by an ion-wind can be sufficient to carry away air present in the immediate vicinity of the corona electrode through a conduit which has an open end located downstream of an in line with the corona electrode. Although such an arrangement can be possible in certain instances, it will in many instances require the provision of an additional fan for withdrawal by suction of the air removed from the immediate vicinity of the corona electrode, for instance when the air removed is to be conducted through a long path, for instance, to free atmosphere, or through a filter which presents a given resistance to flow. This presents a serious disadvantage in the case of air transporting arrangements which operate with ion-winds, since one of the important advantages provided by such arrangements is precisely the fact that they do not require bulky, expensive and noisy fans with associated drive motors for air transportation purposes. The object of the present invention is therefore to provide an improved arrangement of air transporting systems of the aforedescribed kind operating with electric ion-winds, so as to eliminate the harmful or irrating substances, primarily ozone and oxides of nitrogen, produced by the corona discharge, so that these substances will not accompany and contaminate the air transported through the arrangement.

Figure 2:
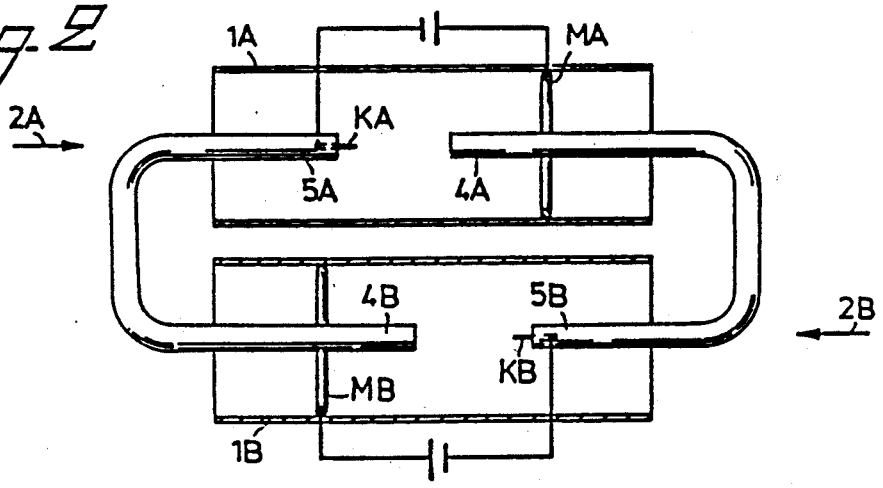
Figure 3:
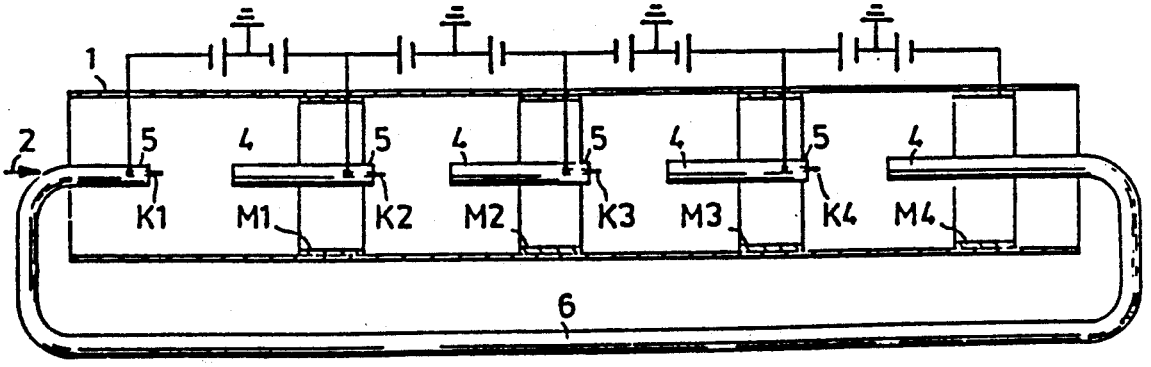

The invention will now be described in more detail with reference to the accompanying drawings, in which FIG. 1 illustrates schematically a first exemplifying embodiment of an arrangement constructed in accordance with the invention, in axial section;

FIG. 2 illustrates in a corresponding manner a second exemplifying embodiment of the invention; and FIG. 3 illustrates in a corresponding manner a third exemplifying embodiment of the invention.

FIG. 1 is a schematic illustration of the principle construction of an air transporting arrangement which utilizes an electric ion or corona wind. The arrangement includes an airflow duct 1 of circular cross-section, in which a corona electrode K and a target electrode M are arranged in axial spaced relationship, with the corona electrode K located upstream of the target electrode, as seen in the desired direction of airflow through the channel 1, marked with an arrow 2. The corona electrode K is a needle electrode or pointed electrode and is arranged coaxially in the duct 1. The target electrode M of the illustrated embodiment is cylindrical in shape, and may comprise a separate electrode element or may be mounted directly on the inside surface of the duct 1. The corona electrode K and the target electrode M are each connected to a respective terminal of a d.c. voltage source 3, the voltage of which is such as to generate a corona discharge at the corona electrode K. Suitable selection of the voltage of the voltage source 3 and the distance between the corona electrode K and the target electrode M will result in the occurrence of an ion - wind, and therewith in transportation of air, through the duct 1 in the direction of the arrow 2, as described in more detail in the aforesaid international patent application.

As mentioned above, the corona discharge at the corona electrode K will produce substances, primarily ozone and oxides of nitrogen, which are irritating and possibly harmful to humans and which therefore cannot be permitted to accompany the airflow generated through the duct 1, when the arrangement is intended for use in human environments.

For the purpose of avoiding the entrainment of such irritants, the inventive arrangement is provided with a separate arrangement which includes a first tube 4 which is located downstream of the corona electrode K and which has an open end 4A located axially in line with the corona electrode, and a second tube 5 which is arranged upstream of the corona electrode K and has an open end 5A located slightly upstream of but closely adjacent to and axially in line with said corona electrode, which may be located partially within the end of the tube 5. Both tubes 4 and 5 have a circular cross-section whose diameter is considerably smaller than the diameter or cross-dimension of the airflow duct 1, and the tubes are connected together through an external tubular connector 6, illustrated schematically in the drawing. Tests have shown that the airflow generated through the duct 1 by the ion-wind causes the air located in the immediate vicinity of the corona electrode K and containing the harmful substances generated by the corona discharge, to flow into the tube 4, through the open end 4A thereof. This air quantity, which constitutes a very small part of the total air quantity flowing through the duct 1, is led from the tube 4, through the hollow tubular connector 6, to the tube 5 and thus flows back out through the open end 5A of the tube 5 into the immediate vicinity of the corona electrode K, i.e. to the region of the corona discharge. It has been suprisingly found that in the steady state, which is established very quickly, within the space of at most some minutes, a constant, relatively high concentration of the harmful substances generated by the corona discharge is established in the air flowing through the tubes 4, 6 and 5, whereas the the concentration of harmful substances in the airflow leaving the outlet end 1A of the airflow duct 1 coincides with the concentration of the harmful substances in the surrounding ambient air. Consequently, the arrangement will not cause an addition to the air transported through the arrangement of harmful substances, primarily ozone and oxides of nitrogen, generated by the corona discharge. The arrangement can thus be used in a human environment to no detriment. By way of example, it can be mentioned that when carrying out experiments on the inventive arrangement, an ozone concentration of about 1 ppm was measured in the air flowing through the tubular conduit 6 in a steady state condition, whereas the instantaneous ozone concentration in the air exiting through the outlet end 1A of the flow duct 1 was found to be in the order of 0.001–0.01 ppm and coincided essentially with the ozone concentration of the surrounding atmospheric air.

The reason for this very surprising result is believed to be because the harmful substances, in the form of ozone and nitrogen oxides (NOx) present in the air exiting through the open end 5A of the tube 5, are decomposed under the influence of the electric field prevailing in the corona discharge zone at the same rate as further substances of this nature are generated under the influence of the corona discharge. This may possibly be because the field strength required for decomposing the substances concerned is lower than the field strength required to produce said substances. Despite the fact that the physical mechanism has not been fully investigated in all its respects, it has nevertheless been possible to establish reliably the result achieved in practice.

It will be understood that in order for the inventive arrangement to function satisfactorily, it is important that the air flowing in the immediate vicinity of the corona electrode K will actually flow into the downstream located tube 4, through the open 4A thereof, i.e. that the airflow is linear and axially directed from the vicinity of the corona electrode K to said open end of the tube 4.

This is not difficult to achieve. It will also be understood that the open end 4A of the tube 4 can be advantageously located as close as possible to the corona electrode K. It must be ensured, however, that the tube 4 will not "hide" the target electrode M from the corona electrode K, and that the migration of ions from the corona electrode K to the target electrode M, necessary for producing the ion-wind, is not obstructed. When this condition is fulfilled, it has been found that the tubes 4 and 5 will have no disturbing effect on the corona discharge or on the desired ion migration from the corona electrode K to the target electrode M. On the contrary, the tube 5 located immediately upstream of the corona electrode K has the advantage of effectively shielding the corona electrode K in the upstream direction, such as to prevent undesirable ion migration from the corona electrode K in the upstream direction. eference is made to the earlier mentioned international patent application for a more detailed explanation of the need of such a screen.

The present invention thus eliminates, highly effectively, the risk of harmful substances, such as ozone and nitrogen oxides, generated by the corona discharge from dispersing to ambient air in air transporting arrangements which operate with ion-winds. This enables such arrangements to be used in human environments without detriment, and also enables the use of high corona currents, negative corona discharge and needle electrodes or pointed corona electrodes without disadvantage, or to great advantage with respect to the effectiveness of the arrangement. It will also be seen that the inventive arrangement is extremely simple and inexpensive, and requires no additional fans or filters or like devices for rendering harmful substances innocuous. It will be understood, however, that it is possible to install in the connector 6 between the two tubes 4 and 5, devices which will render the harmful substances innocuous, e.g. such devices as carbon filters or devices for irradiating the air with ultraviolet radiation. Such measures, however, are not necessary in normal instances.

It will be understood that an arrangement according to the invention can be constructed in many different ways, depending upon the actual air transporting arrangement operating with ion-wind.

FIG. 2 illustrates schematically, and by way of example, a possible enbodiment or an inventive arrangement in an air transporting system which comprises two airflow ducts 1A and 1B arranged parallel with and adjacent to one another, and each of which has mounted therein a corona electrode KA and KB respectively and a target electrode MA and MB respectively, arranged for mutually opposite airflow directions 2A and 2B through the two ducts 1A and 1B. In the case of this air transporting system, the tubes 4A and 5A in the airflow duct 1A are connected to the corresponding tubes 4B and 5B in the duct 1B in the illustrated manner. It will be seen that the modus operandi is the same as that of the earlier arrangement described with reference to FIG. 1. Although not shown in FIG. 2, it will be understood that the same voltage source can be used for the electrodes in both airflow ducts 1A and 1B.

FIG. 3 illustrates schematically, and by way of example, a highly advantageous embodiment of an air transporting system operating with ion-wind, this system being made possible as a result of the present invention.

In the case of this air transporting arrangement, the airflow duct 1 has arranged therein in axial, sequential relationship a multiple of corona electrode and target electrode arrays, K1/M1, K2/M2, K3/M3 and K4/4 respectively. The corona electrode of a downstream located electrode array, for instance the corona electrode K2, is located, when seen axially, approximately opposite the target electrode M1 of the nearest upstream electrode array, and is connected to the same electrical potential as this target electrode. The various electrode arrays will thus operate alternately with negative and postive corona discharge. This arrangement obviates the problem of insulation between mutually adjacent corona electrodes and target electrodes and provides highly effective screening of the corona electrodes against undesirable ion migration in an upstream direction in the duct 1. The tubes 4, 5 arranged in accordance with the invention for handling the air which flows in the immediate vicinity of the corona electrodes and which is laden with harmful substances are situated and interconnected in the illustrated manner, which prevents, highly effectively, said harmful substances from mixing with an contaminating the air flowing through the duct 1. The electrical voltage is advantageously supplied to the electrodes in a manner such that the corona electrodes and target electrodes will be connected alternately to potentials of opposite and symmetrical polarities relative to earth. Although not shown for the sake of clarity, there will naturally be used in practice the same voltage sources for all electrode arrays.

When an air transporting arrangement or system which employs the inventive concept includes a multiple of mutually parallel and mutually adjacent airflow ducts, an advantage is afforded when the outer surfaces of said ducts are provided with an electrically conductive layer or coating which is connected to one and the same electrical potential, e.g. earth potential, for all airflow ducts. this will ensure that the walls of the various airflow ducts will not be charged electrostatically at mutually different potentials, which might then result in an asymmetric airflow in some of the ducts. As before mentioned, an asymmetric airflow is not desirable, since it must then be ensured that the open end 4A of the tube 4 located downstream of a corona electrode K will positively receive the air flowing past in the immediate vicinity of the corona electrode K, which air will contain the harmful substances generated by the corona discharge.

We claim:

1. An air transporting arrangement comprising an airflow duct (1), a corona electrode (K) and at least one target electrode (M) located in axial spaced relationship in the airflow duct, with the corona electrode located upstream of the target electrode, and further including a d.c. voltage source (3) to which the terminals of the corona electrode and the target electrode are connected, wherewith the shape of the corona electrode and the voltage of the voltage source are such as to produce an ion-generating corona discharge at the corona electrode, characterised by a first tube (4) having an open end (4A) which is located downstream of and axially in line with said corona electrode (K) and faces towards said corona electrode such that the air flowing in the immediate vicinity of the corona electrode (K) will pass into the open end (4A) of said first tube (4); a second tube (5) having an open end (5A) which is located upstream of and axially in line with the corona electrode (K) and directed downstream, wherein said first and said second tubes (4, 5) are so connected (6) with one another that the air flowing into the first tube (4) through the open end (4A) thereof is conducted to the second tube (5) and flows out through the open end (5A) of said tube.

2. An arrangement according to claim 1, characterised in that the open end (5A) of the second tube (5) is located closely adjacent to the corona electrode (K), such that the air flowing out through the open end (5A) of the second tube (5) will flow past the corona electrode (K) in the immediate vicinity thereof.

3. An arrangement according to claim 1, characterised in that the open ends (4A, 5A) of respective tubes (4, 5) have a cross-section whose area which is considerably smaller than the cross-sectional area of the airflow duct (1), such that the quantity of air flowing through said tubes (4, 5) will be very small in comparison with the quantity of air flowing through the airflow duct (1).

4. An arrangement according to claim 1, characterised in that the corona electrode (K) is needle-shaped or pointed and is positioned axially in the airflow duct (1); and in that the open ends (4A, 5A) of respective tubes (4, 5) are circular in shape.

5. An arrangement according to claim 1, characterised in that the connection between the first tube (4) and the second tube (5) incorporate means for cleansing the air flowing from the first tube (4) to the second tube (5) of substances which are produced by the corona discharge and are harmful or irritating to humans.

6. An arrangement according to claim 1, characterised in that the arrangement includes two airflow ducts (1A, 1B) arranged in mutually parallel and mutually adjacent relationship and each of which includes a corona electrode (KA, KB) and a target electrode (MA, MB) arranged for airflow in mutually opposite directions (2A, 2B) in the two airflow ducts (1A, 1B); and further includes a first tube (4A, 4B) and a second tube (5A, 5B) having open ends which are arranged in the aforesaid manner, wherein the first tube (4A) in one airflow duct (1A) is connected to the second tube (5B) in the other airflow duct (1B) and vice versa.

7. An arrangement according to claim 1, characterised in that the airflow duct (1) includes a plurality of corona electrode arrays (K1–K4) and target electrode arrays (M1–M4) arranged axially and sequentially in the duct, with associated first and second tubes (4, 5), and in that the first tube (4) belonging to an upstream located electrode array is connected to the second tube (5) of the nearest downstream located electrode array; and in that the first tube (4) of the last electrode array (K4, M4) seen in the flow direction is connected to the second tube (5) of the first electrode array (K1, M1) seen in the flow direction.

8. An arrangement according to claim 7, characterised in that the corona electrodes (K1–K4) are connected alternately to two different potentials; and in that the target electrode (M1–M3) of an upstream located electrode array is connected to the same potential as the corona electrode (K2–K4) of the nearest downstream located array.

9. An arrangement according to claim 8, characterised in that said two mutually different potentials are symmetrical in relation to earth potential.

10. An arrangement according to claim 1, characterised in that the arrangement includes a plurality of mutually parallel and mutually adjacent airflow ducts; and in that the outer surfaces of the airflow ducts are provided with an electrically conductive coating which is connected to one and the same electrical potential for all ducts.

* * * * *